US005178122A

United States Patent [19]

Simonds

[11] Patent Number: 5,178,122

[45] Date of Patent: Jan. 12, 1993

[54] ARCHERY BOW CABLE GUARD MOUNT

[75] Inventor: Gary L. Simonds, Gainesville, Fla.

[73] Assignee: Bear Archery Inc., Gainesville, Fla.

[21] Appl. No.: 775,479

[22] Filed: Oct. 15, 1991

[51] Int. Cl.[5] ..... F41B 5/00

[52] U.S. Cl. ..... 124/25.6; 124/88

[58] Field of Search ..... 124/23.1, 25.6, 86, 124/88; 403/93, 97, 358-360

[56] References Cited

U.S. PATENT DOCUMENTS

| | | | |
|---|---|---|---|
| 1,406,767 | 2/1922 | Slater | 403/93 |
| 3,052,492 | 9/1962 | Schmitz et al. | 403/93 |
| 4,377,152 | 3/1983 | Saunders | 124/88 |
| 4,452,222 | 6/1984 | Quartino et al. | 124/88 X |
| 4,582,445 | 4/1986 | Warshawsky | 403/97 |
| 4,704,800 | 11/1987 | Stinson | 124/88 X |
| 4,903,678 | 2/1990 | Walker | 124/88 X |
| 5,002,035 | 3/1991 | Brooks | 124/88 X |

OTHER PUBLICATIONS

"Jennings 92" Catalog, *Posi-Lock Cable Guard*, Jan. 31, 1992.

*Primary Examiner*—Randolph A. Reese
*Assistant Examiner*—Jeffrey L. Thompson
*Attorney, Agent, or Firm*—Malina & Wolson

[57] ABSTRACT

An adjustable cable guard mount which includes a pair of mounting means the first of which is inserted in or formed on an archery bow proximate the handle and having a symmetrical, multi-faced splined first mating portion. The second mounting means carries a deflector rod and includes a second mating portion formed to mate with the first mating portion. The first and second mounting means are held in their coupled relationship by a retaining means. By permitting the coupling of the first and second mounting means in a plurality of orientations the degree of tension cable and bowstring separation can be selectively adjusted.

15 Claims, 5 Drawing Sheets

ARCHERY BOW CABLE GUARD MOUNT

BACKGROUND OF THE INVENTION

1. Field of the Invention

The present invention relates generally to archery bows and more particularly pertains to cable guards or deflectors for compound archery bows.

2. Description of the Prior Art

Compound archery bows include tension cables and a bowstring which are connected between the upper and lower bow limbs. It is customary, in order to minimize any twisting torque on the bow limbs, to dispose the bowstring and the tension cables relatively close together proximate the vertical centerline of the bow. When, however, the bowstring is released, the travel path of the bowstring, and the arrow is so close to the tension cables, that the tension cables may interfere with the flight of the arrow. In order to prevent any such interference the tension cables must be separated a sufficient distance from the bowstring to permit unrestricted passage of the arrow past the cables.

A popular solution to this problem is to use a cable guard to displace the tension cables from the path of the arrow and the bowstring. One end of the cable guard is attached at the rear surface of the bow handle area and extends in a backward direction to deflect the tension cables away from the path of travel of the arrow.

Presently available cable guards include offset rod mounts which, by rotation of the mount, provide a selectable degree of displacement of the tension cable from the plane of the path of the bowstring. The offset rod mount is generally threaded directly into the bow handle area either above or below the hand grip. The offset rod mount and cable guide are held at a selected rotary orientation by a jam nut, lock collar, set screw, etc.

Secured to the bow as described above, the cable guard exerts a torque on the bow at the handle area when the bowstring is drawn. The forces applied by the tension cables against the cable guard, especially when the bowstring is fully drawn, combined with the torque and the bow vibrations during arrow launch, can cause conventional cable guard locking devices to loosen. Loosening and resulting movement of the cable guard may reduce the clearance between the tension cables and the bowstring. In addition, it is possible to unintentionally displace or rotate the cable guard rod mount away from its selected position when a locking device such as a nut, set screw or collar is being tightened.

SUMMARY OF THE INVENTION

The purpose of the present invention is to provide a cable guard mounting means wherein a cable guard is connected to the bow by a unique locking means. The locking means comprises a pair of coupling means; the first of which is affixed to or formed on the archery bow. The other coupling means carries the cable guard. When the coupling means are joined, the cable guard extends outwardly from the bow handle area and passes between the tension cable and the bowstring.

One coupling means has a symmetrical external multifaced surface for selectably mating with a symmetrical internal multifaced surface of the other coupling means. Means are provided to hold the coupling means in positive interlocking engagement. The interlocking symmetrical surfaces permit the user to selectively position the cable guard and thereby set the degree of separation between the bow tension cables and the path of the bowstring and arrow.

Accordingly, it is an object of the present invention to provide a cable guard mount for an archery bow cable guard wherein the cable guard is firmly and positively locked in position.

Another object of this invention is to provide a cable guard mount for an offset bow cable guard wherein the cable guard can be locked in various desired rotary orientations to thereby set the degree of cable and bowstring separation.

Other objects and the attendant advantages of this invention will be readily appreciated as the same becomes better understood by reference to the following detailed description when considered in connection with accompanying drawings in which like reference numerals designate like parts throughout the figures thereof.

DETAILED DESCRIPTION OF THE PREFERRED EMBODIMENTS

Figure 1:
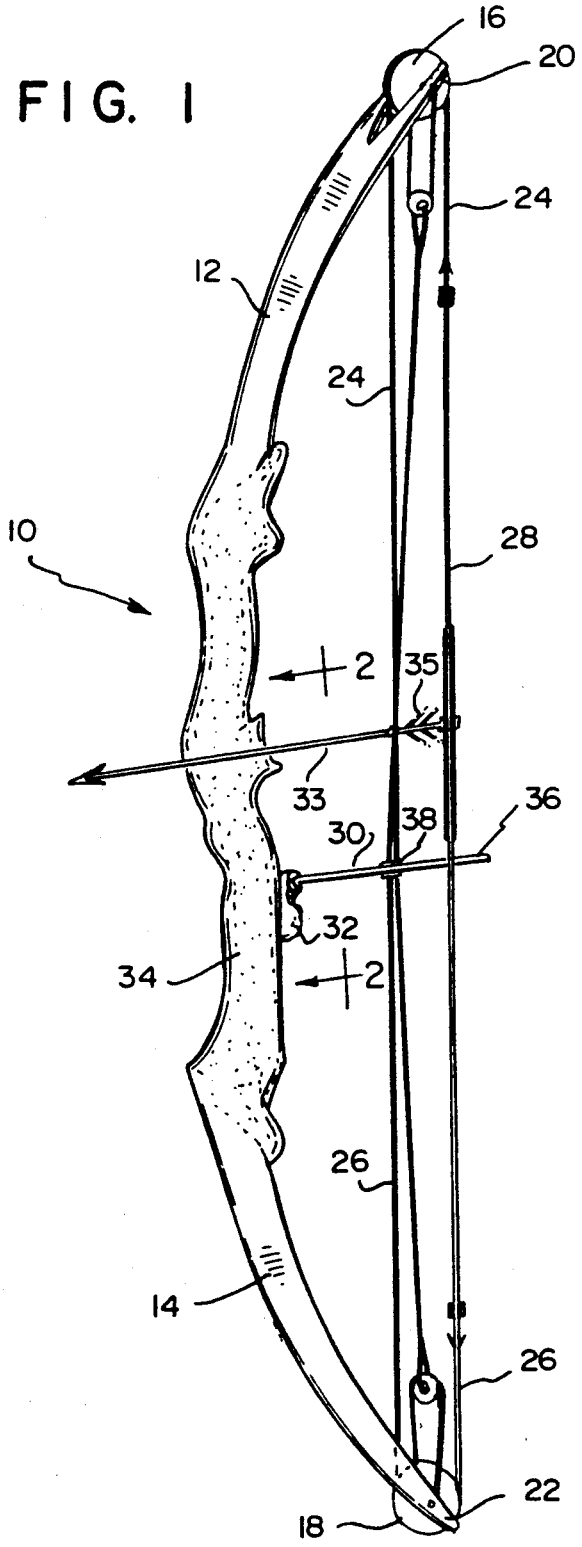
FIG. 1 is a side perspective view of a compound archery bow including the cable guard mount constructed in accordance with the present invention.

In the illustrated embodiment of FIG. 1 a compound archery bow generally designated at 10 includes a pair of opposed bow limbs 12 and 14 which carry centrally disposed eccentric pulleys 16 and 18 at their outer tip ends 20 and 22. Tension cable segments 24 and 26 have portions which travel in grooves of the eccentric pulleys 16 and 18 in known manner. A bowstring 28 is connected between the free ends of tension cable segments 24 and 26. Tension cable segments 24 and 26 and the bowstring 28 lie close to a plane formed central and perpendicular to the bow limbs. A tension cable guard 30 is attached, by an offset mounting means 32, to the bow 1o proximate the bow handle area 34 and includes a rearwardly extending deflector rod 36. The deflector rod 36 bears against the tension cable segments 24 and 26 and is disposed in a plane between the tension cable segments 24 and 26 and the bowstring 28 to thereby displace the tension cable segments 24 and 26 from the path of the bowstring 28. By employing an offset mounting means 32 which can be angularly adjusted (in a manner to be further described) deflector rod 36, can displace the cable tension segments 24 and 26 a selected amount. The cable displacement is sufficient to permit the arrow 33 and fletches 35 thereon to pass unimpeded by the cable tension segments 24 and 26.

Figure 3:
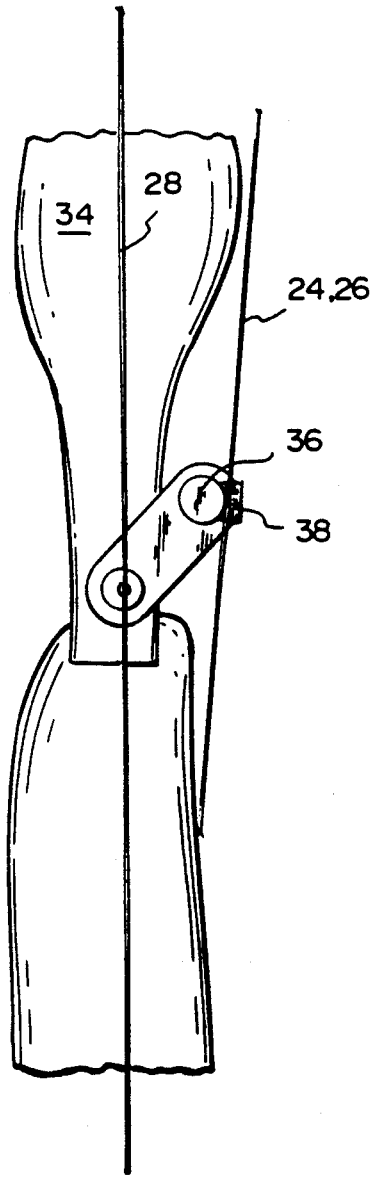
FIG. 3 is a side elevation view taken along line 3—3 of FIG. 2.
Figure 2:
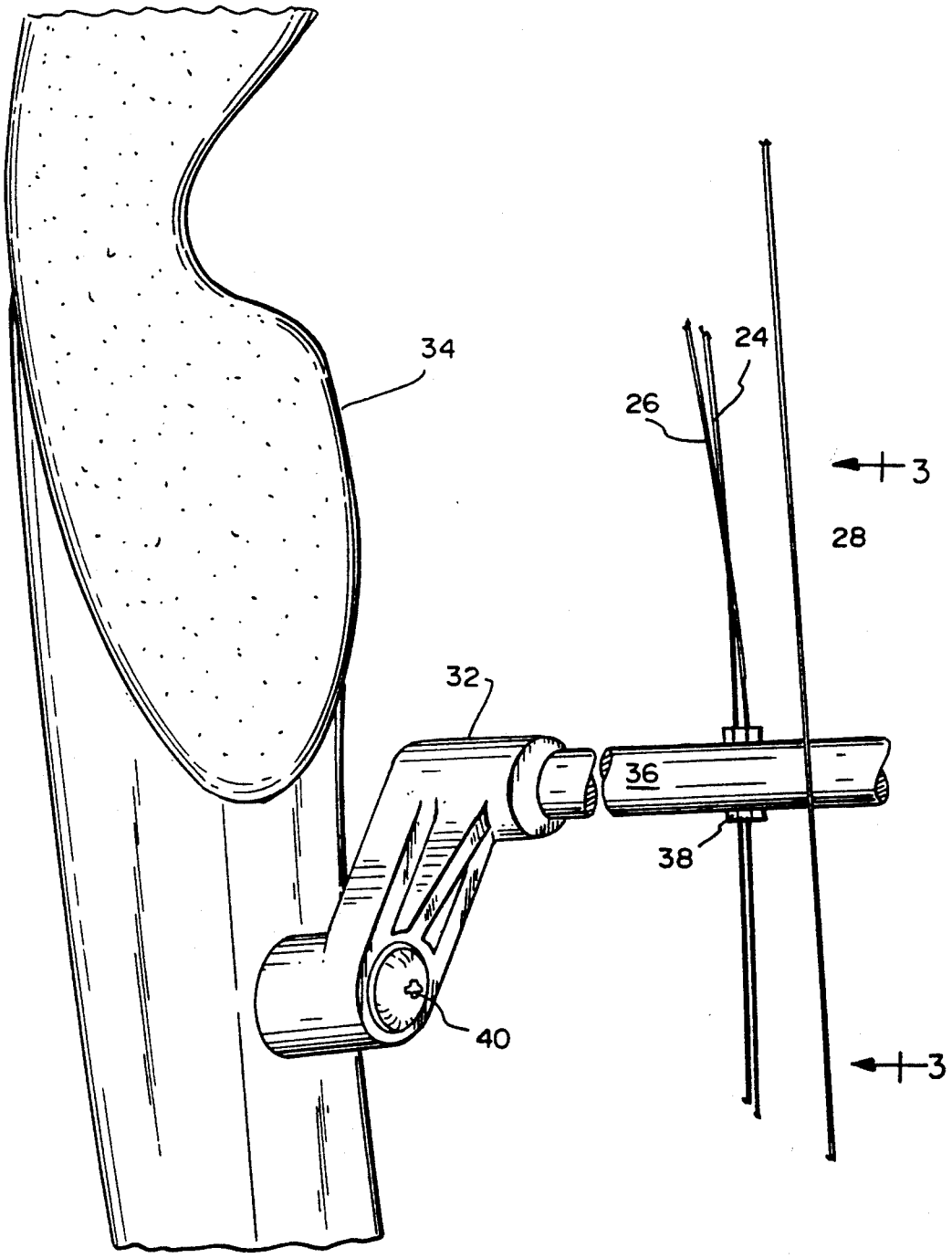
FIG. 2 is perspective view of a part of the bow handle area taken in the direction of arrows 2—2 of FIG. 1.

Offset mounting means 32 is coupled to and extends from the bow handle area 34 with the deflector rod 36 supported by the offset mounting means 32 as shown in FIGS. 2 and 3. The deflector rod 36 extends rearwardly of the bow 10 and engages cable guide retainer 38 through which the tension cable segments 24 and 26 move when the bowstring 28 is drawn and released. Clockwise rotation of the offset mounting means 32 about its axis 40 from the vertical causes the deflector rod 36 to increasingly deflect the tension cable segments 24 and 26 away from the bowstring 28.

Figure 4:
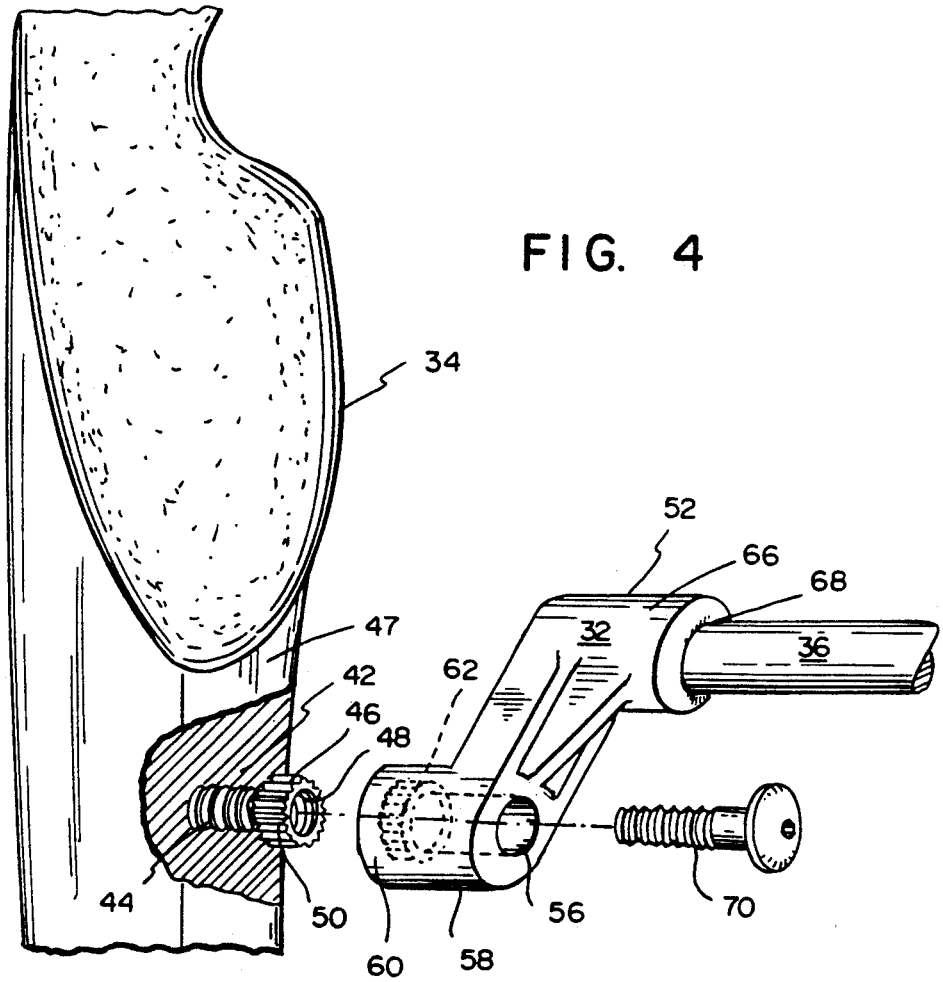
FIG. 4 is an exploded , partially cutaway, perspective view of the cable guard mount of FIG. 2.

In the illustrated embodiment of FIG. 4 a first coupling means 42 may be formed in the bow handle area 34 or affixed therein by any suitable means such as a cast insert, an insert fastened by adhesive means or by threading the externally tapped insert portion 44 into a mating threaded aperture (not shown) in the bow handle area 34. The first coupling means 42 further includes a first mating portion 46 which extends outwardly of the bow surface 47 to expose the first mating portion 46. The first coupling means 42 is provided with an internally threaded bore 48. The first mating portion 46 is formed with an external, splined surface 50.

The second coupling means 52 includes an offset mounting means 32 with an opening 56 extending through its lower arm 58. Second mating portion 60 of arm 58 has embedded or formed therein an internal splined surface 62 for mating with external splined surface 50 of first coupling means 42. Deflector rod 36 is attached to the other arm 66 of offset mounting means 32 by being snugly inserted into hole 68 in the other arm 66 and secured therein by shrink fitting, pins, set screws, or adhesive (not shown) extending transversely through the other arm 66 and into deflector rod 36. The deflector rod 36 may be formed integral with the offset mounting means 32.

The tension cable guard 30 of this embodiment is assembled by selectively orienting the second mating portion 60 of offset mounting means 32 into coaxial mating engagement with the first mating portion 46 of first coupling means 42. External splined surface 50 of first mating portion 46 engages the internal splined surface 62 so as to provide a positive coupling between the first coupling means 42 and offset mounting means 32. External and internal splined surfaces 50 and 62 are coaxial. The first coupling means 42 and offset mounting means 32 are retained in positive engagement by capscrew 70 which extends through opening 56 and threads into internally threaded bore 48 of first coupling means 42. By employing offset mounting means 32 which can be angularly adjusted, deflector rod 36 can displace the cable tension segments 24 and 26 a selected amount.

Figure 5:
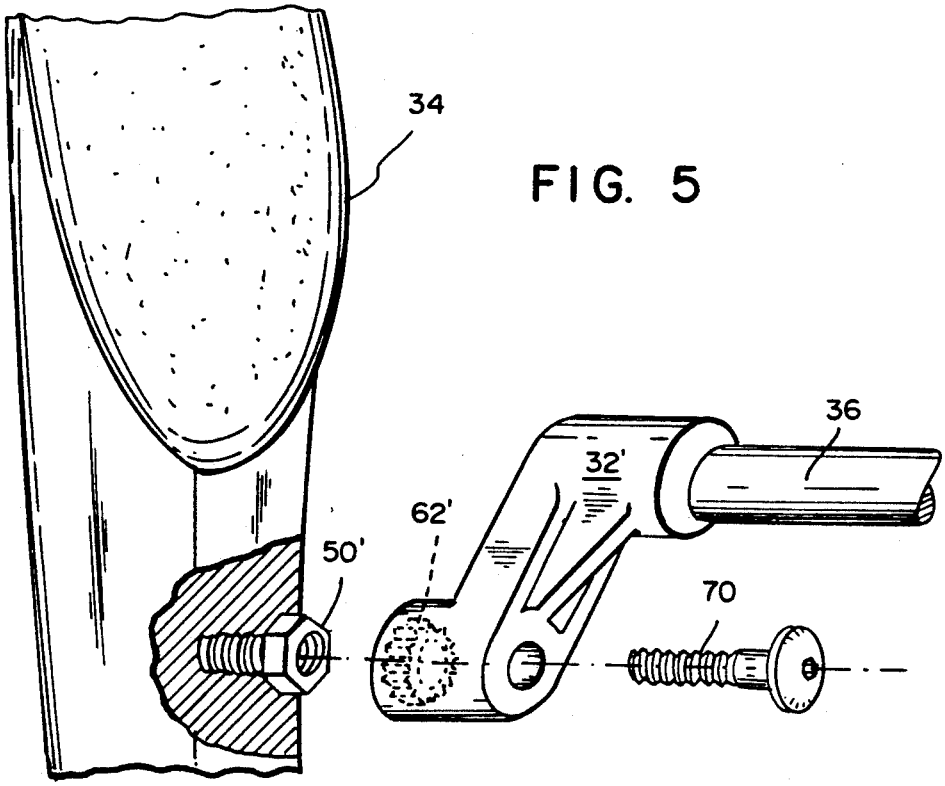
FIG. 5 is an exploded, partially cutaway, perspective view similar to that of FIG. 4 of a second cable guard mount made in accordance with the present invention.
Figure 6:
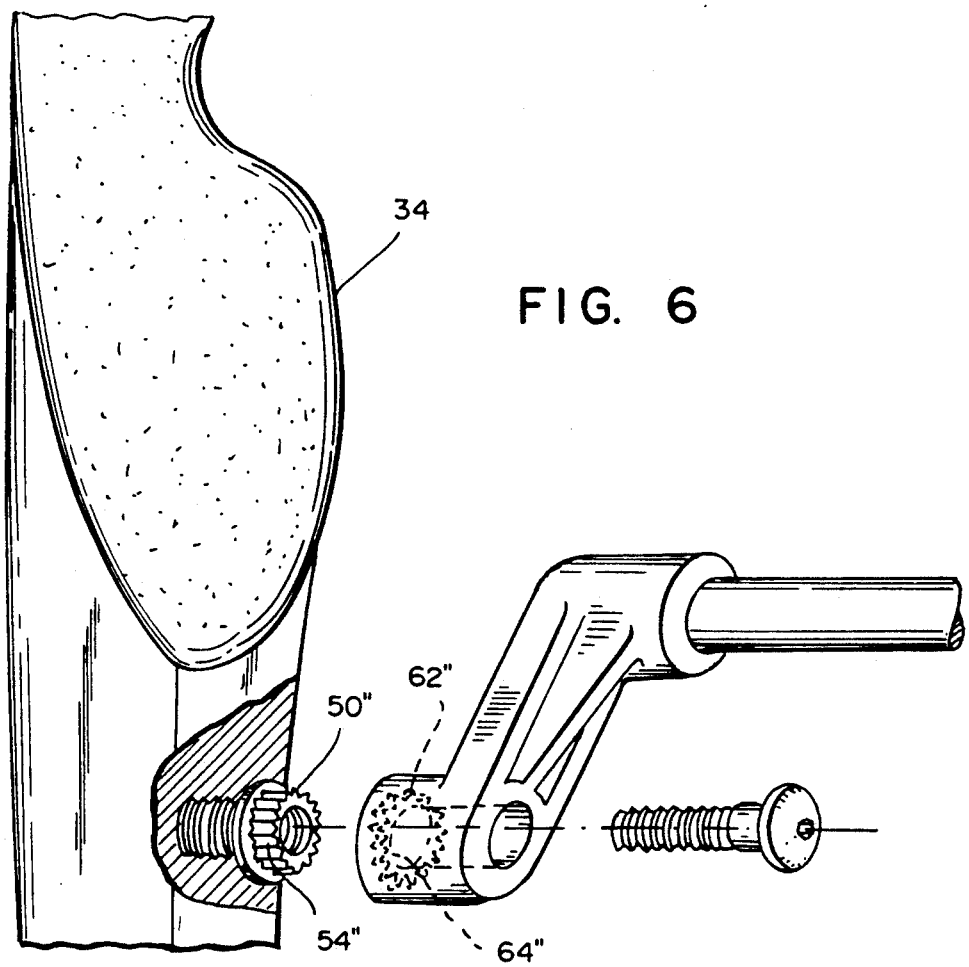
FIG. 6 is an exploded, partially cutaway, perspective view similar to that of FIG. 4 of a third cable guard mount made in accordance with the present invention.

The embodiments illustrated in FIGS. 5 and 6 are similar to the embodiment shown and described with respect to FIG. 4 except for the configuration of the splined mating portions.

In the embodiment of FIG. 5, the external splined surface 50' is a hexagonal nut head and the internal splined portion 62' of offset mounting means 32' may take the configuration of a six, twelve or eighteen point standard socket wrench. The external splined surface 50' can, of course, be formed with more than six sides provided only that the socket points of internally splined surface 62' be sufficient to accommodate the external splined surface 50'.

The embodiment of FIG. 6 includes an external splined surface 50" in the form of a gear shape with a plurality of teeth 54" that matingly engage the internal teeth 64" of internal splined surface 62".

Figure 7:
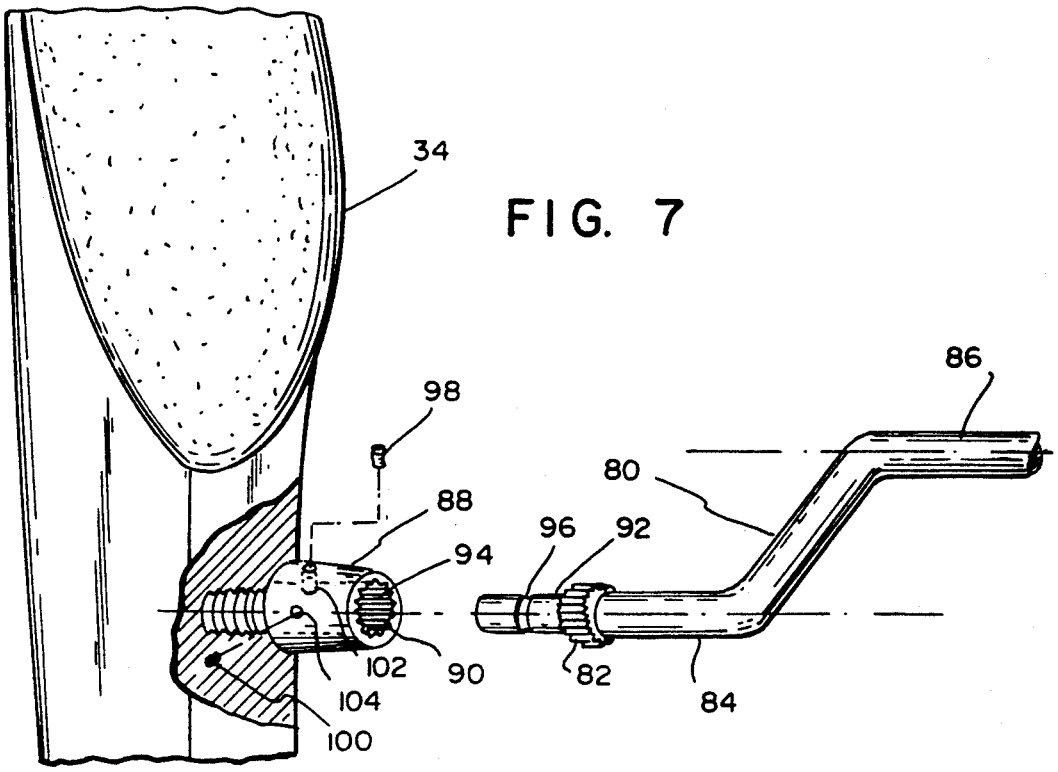
FIG. 7 is an exploded, partially cutaway, perspective view similar to that of FIG. 4 of a fourth cable guard mount made in accordance with the present invention.

Referring now to FIG. 7 wherein the offset deflector rod 80 is formed with an outwardly directed multi-splined ring portion 82 on arm 84. The opposite arm 86 constitutes the deflector portion of the offset deflector rod 80 which engages the bow tension cable guide retainer (not shown). The first coupling means 88 includes an internally splined surface 90 formed to mate with the splines of ring portion 82 when the forward end 92 of rod arm 84 is inserted into the opening 94 of first coupling means 88. The forward end portion 92 may be formed with a circular peripheral groove 96 into Which the ends of set screws 98 and 100 extend. The set screws 98 and 100 are threaded into radial openings 102 and 104 in first coupling means 88 to thereby engage the groove 96 and retain the first coupling means 88 in positive engagement with the offset deflector rod 80, in whichever angular position of the offset deflector rod 80 is desired.

The external and internal splined surfaces of the foregoing embodiments may be interchanged. It will be appreciated that the greater the number of splines the greater the adjustability of the deflector rod orientation and degree of cable deflection.

Figure 8:
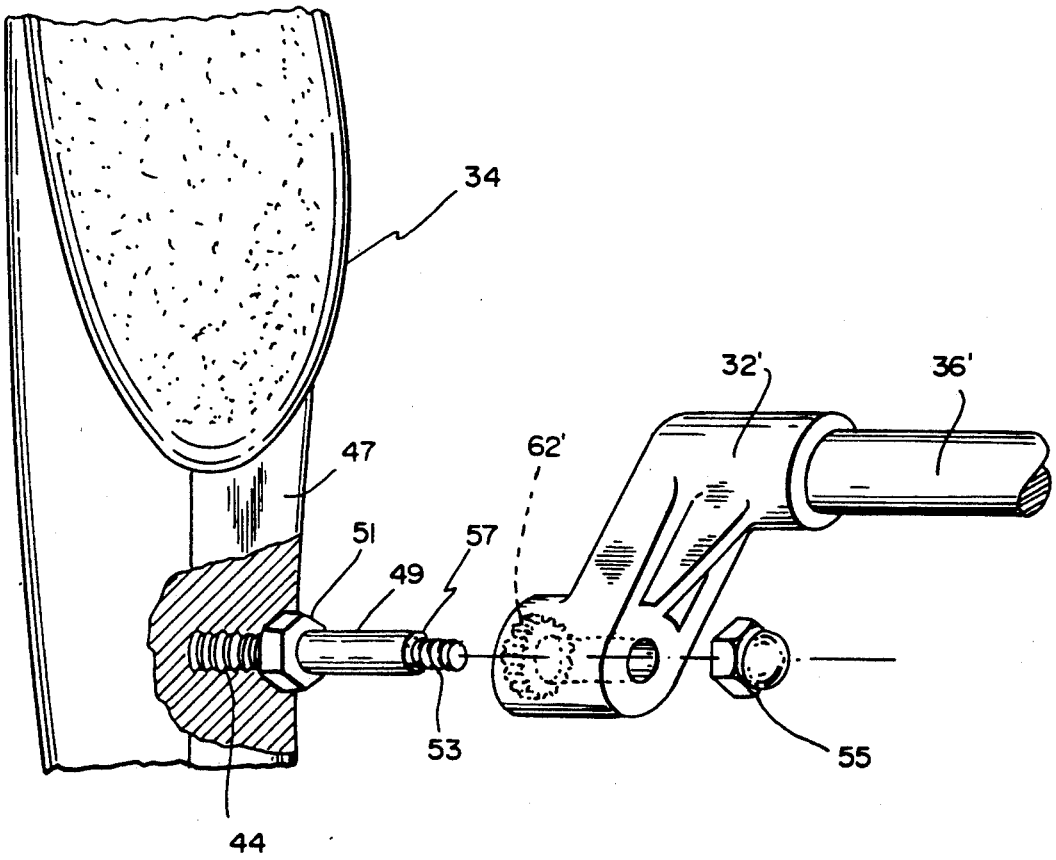
FIG. 8 is an exploded, partially cutaway, perspective view similar to that of FIG. 4 of a fifth cable guard mount made in accordance with the present invention.

In the embodiment of FIG. 8, the external splined surface 51 is a hexagonal nut formed as a part of a mounting stud 49. The mounting stud 49 has an externally tapped insert portion 44 on one end that can be threaded into a mating threaded aperture (not shown) in the bow handle area 34. The other end 57 of mounting stud 49 is provided with standard threads 53 that mate with the clamping nut 55.

Mounting stud 49 may thus be used as an adaptor so that bow handles not normally equipped with an external multifaced surface can be converted to accept the internally multifaced offset coupling means 62 in positive interlocking engagement.

Obviously, many modifications and variations of the present invention are possible in the light of the above teachings. It is therefore understood that, within the scope of the appended claims, the invention may be practiced otherwise than specifically described.

Having thus described the invention, what is claimed is:

1. A compound archery bow having limbs extending outwardly in opposite coplanar directions and terminating in limb tip means, a bow handle portion connected between the free ends of said limbs, a bowstring and tension cables intermediate said bow tip means, and a cable guard mount comprising:

a first coupling means carried by said bow and including a first mating portion; and a second coupling means including a deflector rod which deflects the tension cables from the path of the bowstring and a second mating portion including means for positive interlocking mating engagement against rotary displacement with said first mating portion.

2. The cable guard mount according to claim 1 wherein said first and second mating portions are coaxial.

3. A compound archery bow having limbs extending outwardly in opposite coplaner directions and terminating in limb tip means, a bow handle portion connected between the free ends of said limbs, a bowstring and tension cables intermediate said bow tip means, and a cable guard mount comprising:

a first coupling means carried by said bow and including a first mating portion; and a second coupling means including a deflector rod which deflects the tension cables from the path of the bowstring and a second mating portion for positive mating with said first mating portion, said first and second mating portions include splined surfaces whereby said surfaces may be coupled together in a plurality of orientations so that said deflector rod may displace the tension cables in varying amounts.

4. The cable guard mount according to claim 3 wherein one of said splined surfaces is internal and the other of said splined surfaces is external.

5. The cable guard mount according to claim 4 further including retaining means for holding said first and second coupling means in coupled relation.

6. The cable guard mount according to claim 5 wherein said retaining means includes a capscrew.

7. The cable guard mount according to claim 5 wherein said retaining means includes a stud and a nut fastening means.

8. The cable guard mount according to claim 5 wherein said retaining means includes a set screw.

9. The cable guard mount according to claim 4 wherein said second coupling means includes an offset mounting means.

10. The cable guard mount according to claim 9 wherein said offset mounting means includes a pair of opposed arms.

11. The cable guard mount according to claim 10 wherein one of said arms supports said deflector rod and the other arm includes said second mating surface portion.

12. The cable guard mount according to claim 11 wherein said other arm is formed with an opening therethrough and further including a capscrew extending through said opening for retaining said first and second mating portions in abutting relation.

13. The cable guard mount according to claim 11 wherein said other arm is formed with an opening therethrough and further including a stud extending through said opening for retaining said first and second mating portions in abutting relation.

14. The cable guard mount according to claim 12 wherein said first mating portion is a hexagonal nut head and said second mating portion is a multipoint socket.

15. The cable guard mount according to claim 12 wherein said first mating portion is a tooth gear and said second mating portion is a socket having internal teeth for mating with said gear teeth.

* * * * *